US009002234B2

(12) United States Patent
Shirayanagi

(10) Patent No.: US 9,002,234 B2
(45) Date of Patent: Apr. 7, 2015

(54) IMAGE FORMING UNIT

(71) Applicant: Canon Kabushiki Kaisha, Tokyo (JP)

(72) Inventor: Jun Shirayanagi, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/732,524

(22) Filed: Jan. 2, 2013

(65) Prior Publication Data

US 2013/0121725 A1 May 16, 2013

Related U.S. Application Data

(63) Continuation of application No. PCT/JP2011/066025, filed on Jul. 7, 2011.

(30) Foreign Application Priority Data

Jul. 7, 2010 (JP) ..... 2010-154961

(51) Int. Cl.
*G03G 21/16* (2006.01)
*G03G 15/00* (2006.01)
*G03G 21/18* (2006.01)

(52) U.S. Cl.
CPC ..... *G03G 21/1839* (2013.01); *G03G 21/1814* (2013.01); *G03G 21/1828* (2013.01)

(58) Field of Classification Search
USPC ..... 399/71, 111, 167, 176, 350
See application file for complete search history.

(56) References Cited

U.S. PATENT DOCUMENTS

| | | | | |
|---|---|---|---|---|
| 6,813,467 | B2 * | 11/2004 | Kawahara et al. | 399/353 |
| 7,865,115 | B2 * | 1/2011 | Oguma et al. | 399/167 |
| 2007/0098438 | A1 | 5/2007 | Yamaguchi | |
| 2007/0248382 | A1 | 10/2007 | Oguma et al. | |
| 2011/0318052 | A1 | 12/2011 | Shirayanagi | |

FOREIGN PATENT DOCUMENTS

| | | |
|---|---|---|
| CN | 101147102 B | 5/2010 |
| JP | 11-095532 | 4/1999 |
| JP | 2004-093869 | 3/2004 |
| JP | 2007-286455 | 11/2007 |

OTHER PUBLICATIONS

Communication in European Patent Application No. 11 80 3710, mailed Nov. 19, 2013.
Office Action in Chinese Patent Application No. 201180033563.5, dated Nov. 3, 2014 (with English translation).

* cited by examiner

*Primary Examiner* — Hoang Ngo
(74) *Attorney, Agent, or Firm* — Fitzpatrick, Cella, Harper & Scinto

(57) ABSTRACT

In a process cartridge detachably mountable to a main assembly of the apparatus and including a photosensitive member and a charging roller, a spacer member for spacing the charging roller from the photosensitive member during the transportation and the displaying is recessed relative to the photosensitive member. The spacer member receives a driving force from the main assembly of the apparatus, by which the spacer member is disengaged to contact the charging roller to the photosensitive member.

4 Claims, 10 Drawing Sheets

(a) SPACED (b) CONTACTED

CURVATURE : RD<R1<R2<<TANGENT LINE (a) SPACED (b) CONTACTED

IMAGE FORMING UNIT

FIELD OF THE INVENTION

The present invention relates to an image forming unit mountable to an image forming apparatus of an electrophotographic type.

BACKGROUND ART

Increasing number of electrophotographic type image forming apparatuses of a unit exchanging type in which the parts relating to the image formation are unified to facilitate the maintenance operation. Most of such image forming units (process cartridge) employs a contact charging type with which a charging roller as a charging member is contacted to a photosensitive member to electrically charge the photosensitive member. In such a process cartridge employing the contact charging type, an image defect may occur due to a deformation or the like of the charging roller if the apparatus is kept unoperated for a long term with the charging roller and the photosensitive member contacted to each other.

In order to suppression such an image defect, the process cartridge is shipped while spacing the photosensitive member and the charging roller from each other by a spacer. The spacer is dismounted by the user who mounts the process cartridge to the device.

Such a structure is cumbersome in that the user has to remove the spacer. If the user operates the image forming apparatus without removing the spacer, a sheet jamming and/or a transfer defect or the like occurs.

Japanese Laid-open Patent Application Hei 11-95532 discloses a structure in which a charging roller kept spaced from the photosensitive member is brought into contact to the photosensitive member by rotation of the photosensitive member. More specifically, the photosensitive member and the charging roller are spaced from each other by a sector gear (spacer member) fitted on a rotation shaft of the charging roller. With such a structure, when the photosensitive member is rotated, the sector gear rotates to contact the charging roller to the photosensitive member.

The process cartridge is vibrated during the transportation or the like from the factory shipment to the mounting to the apparatus. The above-discussed publication uses a sector spacer member which is point-contacted to the photosensitive member. Therefore, the vibration may disengage the spacer member with the result of unintentional contact between the photosensitive member and the charging roller.

To avoid the unintentional intention, it would be considered that the process cartridge is packed with buffering material during transportation. However, the buffering material is disposed after it is taken out of the process cartridge, and therefore, use thereof should be considered with great care. When the buffering material is used, the size of the package of the process cartridge is large with the result of a large load on the environment.

It is an object of the present invention to suppress unintentional disengagement of the spacer member attributable to vibration (falling in an extreme case) during transportation.

DISCLOSURE OF THE INVENTION

The present invention provides an image forming unit detachably mountable to an image forming apparatus, said unit comprising a rotatable photosensitive member, an image formation member contacting the photosensitive member to effect at least a part of image forming process, and a supporting shaft for supporting the image formation member, said image forming unit further comprising a spacer member loose fitted around said supporting shaft to space said photosensitive member and said image formation member from each other; retracting means for transmitting a driving force received from the image forming apparatus to said spacer member to retract said spacer member so as to contact said photosensitive member and said image formation member to each other, wherein said spacer member includes a driven portion for receiving the driving force from said retracting means, and a space keeping portion for keeping the space between said photosensitive member and said image formation member, wherein said space keeping portion has a configuration recessed with respect to a direction from said supporting shaft toward said photosensitive member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

Figure 1:
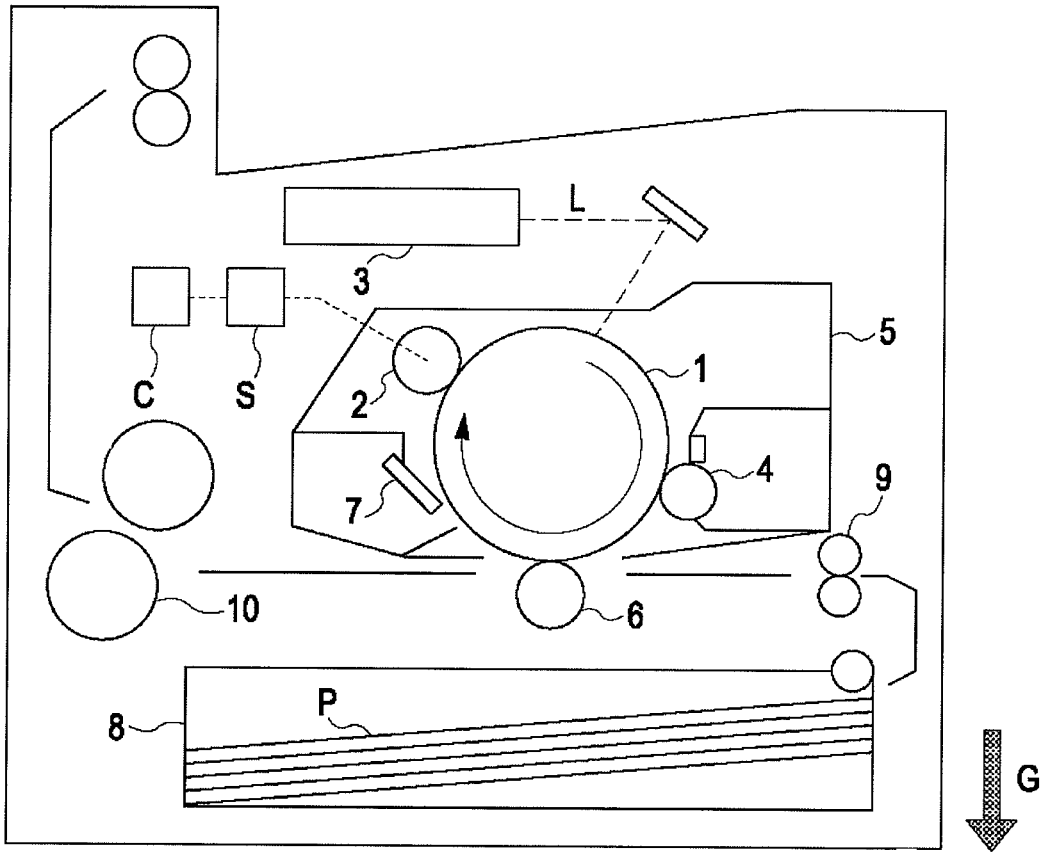
FIG. 1 is a schematic view illustrating a structure of an image forming apparatus.

Referring first to FIG. 1, a general arrangement of an image forming apparatus will be described. Thereafter, a spacing mechanism between a charging roller and a photosensitive member, and a contacting mechanism (automatic contacting structure) operated by a drive input will be described in detail.

1. General Arrangement of Image Forming Apparatus:

As shown in FIG. 1, the image forming apparatus of this example comprises a photosensitive drum 1 as the photosensitive member (image bearing member), and comprises therearound a charging roller 2 as a charging device, a developing device 4, a transferring device 5 and a cleaning device 8 in this order along a rotational moving direction (direction indicated by the arrow) of the photosensitive drum 1. A fixing device 6 is provided downstream of the transferring device 5 with respect to a feeding direction of a recording material P. A process cartridge which is detachably mountable a main assembly of the device and which makes the maintenance easy includes the photosensitive drum 1, the charging device 2, the developing device 4 and the cleaning device 8 as a unit. Next, the description will be made as to individual image forming portions (image formation members) relating to the image formation (image forming process), sequentially.

(Photosensitive Member)

The photosensitive drum 1 as a rotatable image bearing member is a cylindrical (drum type) electrophotographic photosensitive member having a photosensitive layer which is an organic photo-semiconductor having a negative charging property. The photosensitive drum 1 has a diameter of 30 mm and a length of 360 mm, and is rotated by a motor at a process speed of the 150 mm/sec (process speed) in the direction indicated by the arrow (during image formation: forward direction).

(Charging Device)

The charging device of this example employs a structure applying a charging bias voltage to the charging roller 2 as the charging member contacted to the photosensitive drum. More specifically, it has a diameter of 14 mm and a length of and is rotated by photosensitive drum during the image forming operation. The charging roller is urged toward the photosensitive drum by a spring 101. A high voltage source S as an applying means applies to the charging roller a charging bias voltage (DC voltage: −900V, AC peak-to-peak voltage: 1500V) to uniformly charge the photosensitive drum. Here, the charging roller 2 is urged toward the photosensitive drum 1, and therefore, if it is kept unoperated for a long term, a part of the roller is liable to deform. In order to improve a uniform charging of the photosensitive member, the charging roller is a multi-layer structure rubber roller comprising a low molecular weight component of a material rubber, a vulcanization material, a plasticizer or the like. If the charging roller 2 is kept press-contacted to the photosensitive drum 1 for a long term, substance seeping out to a surface of the photosensitive drum 1 may be a cause of an image defect. Therefore, a spacer member for spacing the charging roller 2 from the photosensitive drum 1 is provided. The spacer member will be described in detail hereinafter.

(Other Image Forming Portions)

The exposure device 3 of this example is a laser beam scanner provided with a semiconductor laser for projecting a laser beam L onto the photosensitive drum 1 charged by the charging device 2. More specifically, an electrostatic image is formed on the photosensitive member charged by the charging device on the basis of an image signal inputted to the image forming apparatus.

The developing device 4 visualizes with the developer (toner) the electrostatic image formed on the photosensitive drum 1 by the exposure device 3, into a toner image. The developing device 4, is provided with a developing sleeve, and by application of a developing bias voltage to the developing sleeve, the developer carried on the developing sleeve jumps to the photosensitive member by an electric field. In this example, the toner is deposited on the exposed portion (portion exposed to the laser beam) on the photosensitive drum 1 (reverse development type).

As shown in FIG. 1, the transferring device 6 includes a transfer roller. The transfer roller 5 is press-contacted to the surface of the photosensitive drum with a predetermined urging force, and the press-contact nip is a transfer portion. The recording material P (paper or transparent film, for example) sheet fed from a sheet feeding cassette 8 is fed to the transfer portion by registration rollers 9. The transfer roller is supplied with a transfer bias voltage to transfer the toner image formed on the photosensitive member onto the recording material P. A fixing device 10 fixes the toner image transferred onto recording material. The recording material P subjected to the fixing process is discharged to the outside of the apparatus. A cleaning blade as the cleaning device 8 removes the untransferred toner remaining on the surface of the photosensitive drum 1.

After completion of a series of image forming process operations by the above-described image forming means, the apparatus is prepared for a next image forming operation.

2. Automatic Contacting Structure:

An automatic contacting mechanism will be described. An automatic spacing mechanism of this embodiment includes a spring 101 urging the charging roller 2 toward the photosensitive drum 1, and a spacer member for spacing the charging roller from the photosensitive member. The description will be made in detail as to a configuration (P1) of the spacer member 100 for spacing the photosensitive member and a configuration) thereof for receiving a drive.

(Driving Force Transmission Structure)

Figure 2:
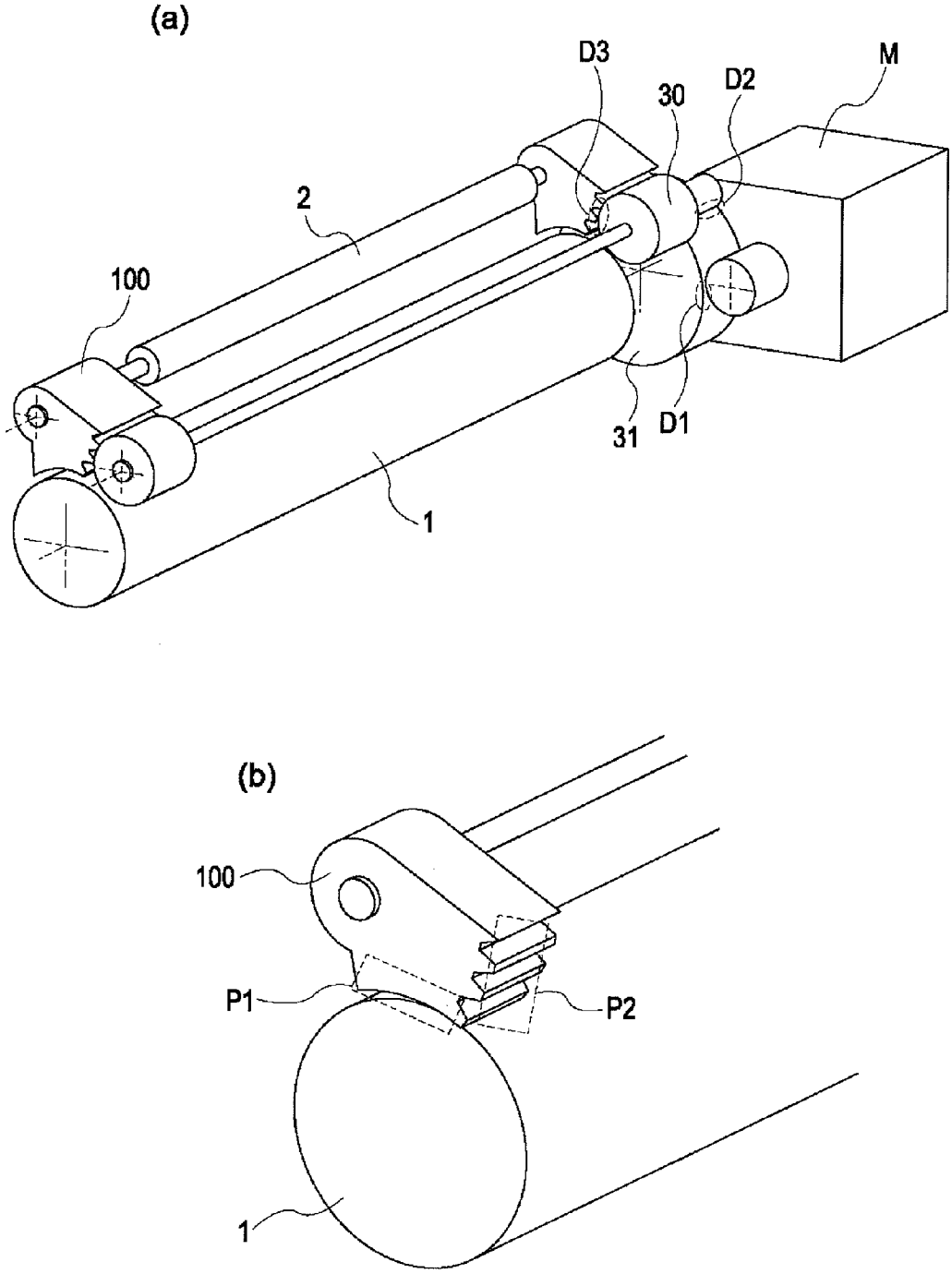
FIG. 2 is a perspective view illustrating a schematic structure of an automatic contacting mechanism.

The process cartridge 5 is detachably mountable (detachably mountable) relative to the main assembly of the image forming apparatus. The process cartridge 5 mounted to the main assembly receives a driving force from a motor M. Part (a) of FIG. 2 is a view illustrating the automatic contacting mechanism for the process cartridge mounted to the main assembly. A driving force from the motor is transmitted to the cartridge through the engagement of a gear 31 for rotating the photosensitive drum 1 and a gear of the motor M as driving means provided in the main assembly side (D1).

In order to rotation the photosensitive drum 1, the transmitted driving force is transmitted to a gear 30 as retracting means contacts the gear 31 (D2). The driving force transmitted to the gear 30 is also transmitted to a driven portion P2 of the spacer member 100 provided at each of the opposite longitudinal end portions of the photosensitive drum (D3). By this, the spacer member 100 provided on the shaft of the charging roller 2 rotates to contact the charging roller 2 having been kept spaced by the spacer member 100 to the photosensitive drum 1. Here, the gear 30 is a double gear, and can provide a torque sufficient to space the spacer member 100. The gear 30 as the retracting means may not be provided in the cartridge. More specifically, the driving force may be inputted directly to the driven portion P2 of the spacer member 100 from the motor M of the main assembly of the apparatus. The gear 30 as the retracting means may be provided on the cartridge to simplify a transmission path of the driving force inputted to the cartridge.

(Spacer Member)

Part (b) of FIG. 2 is a perspective view of the spacer member 100. The spacer member 100 is provided with a space keeping portion P1 for contacting the portion-to-be-contacted (photosensitive member, here) to space the photosensitive drum 1. In this embodiment, the portion-to-be-contacted contact the space keeping portion P1 is the photosensitive drum, but a block or the like of an arcuate configuration (convex toward the charging roller) may be provided as a contact portion in place of the photosensitive drum 1 per se. In addition, the spacer member 100 is provided with a driven portion P2 for being driven by engagement with the gear 30 as the retracting means. Here, the spacer member 100 is rotatable relative to a rotation shaft (supporting shaft) of the charging roller 1. More specifically, the spacer member 100 is loosely (lightly) fitted around the rotation shaft of the charging roller. Here, the rotation shaft of the charging roller has a diameter of 6 mm−0.006 mm/−0.031 mm, and the hole engaging with the rotation shaft of the spacer member has a diameter of 6 mm+0.05 mm/+0 mm (approx. H10/f10, H9/f9, H8/f8 fitting (JIS)).

In addition, the gear as the driven portion has a module 0.6 approx. And a pressure angle 20° approx. The charging roller 1 is urged toward the photosensitive member to be driven stably by the photosensitive member while stably forming a charging gap for charging the photosensitive member. The gear 30 of the retracting means and the driven portion P2 do not receive a compressing force by the urging force. Therefore, there is no such a force as to decrease the distance between the gears, and therefore, the gear bottoms of the driving side gear and the driven side gear are not abutted to each other, thus assuring a backlash. In addition, the gear tooth surfaces are not press-contacted to each other, and therefore, a rotation defect of the gears can be suppressed, and in addition, a rotation abnormality attributable to deformation of the gears and shock attributable to the deformation can be suppressed.

The space keeping portion P1 as the portion-to-be-contacted of the spacer member has a concave configuration relative to the photosensitive member. More specifically, it has a curvature and a center of the radius of curvature opposite from the rotation axis of the charging roller. In other words, the center of the curvature of the space keeping portion P1 of the spacer member 100 is in the rotation axis side of the photosensitive drum 1. In more detail, the radius of curvature of the space keeping portion P1 is 15 mm, for the diameter 30 mm (15 mm in radius) of the photosensitive drum. When the space holding member (sector member) is convex relative to the photosensitive member as in a conventional structure, a point-to-point contact results, and therefore, the structure is not strong against the vibration. In addition, in the conventional structure, after the charging roller and the photosensitive drum are contacted, the rotation of the spacer member is limited by an abutting portion. Here, when the spacer member is lightly fitted around the rotation shaft of the charging roller, the spacer member resists against the rotation of the charging roller. If the photosensitive drum is charged by such a charging roller, charging spots may arise.

(Operation of Automatic Contacting Mechanism)

Figure 3:
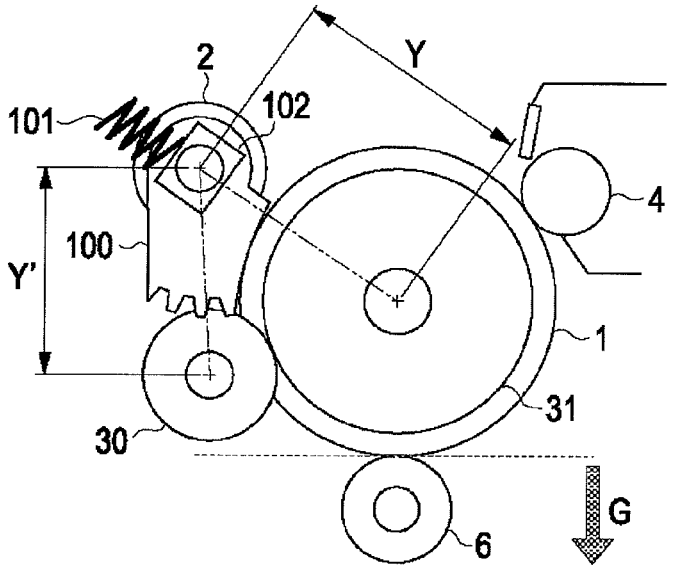
FIG. 3 is a schematic view illustrating a spacing structure.
Figure 3:
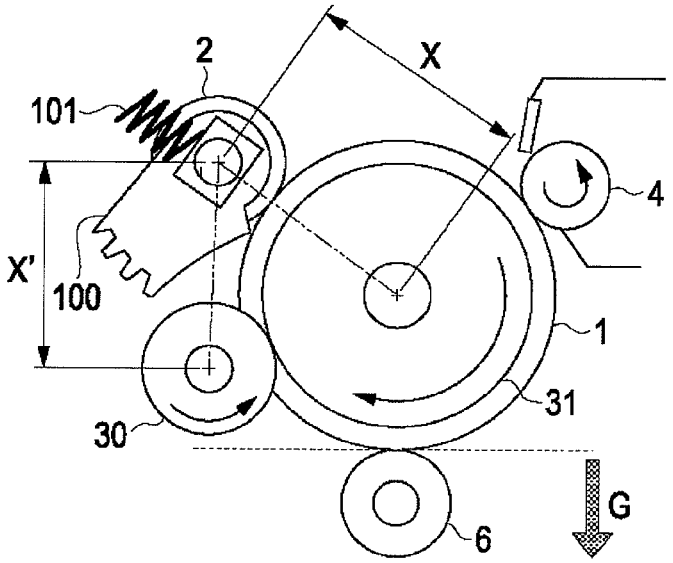

Referring to FIG. 3, operations of the automatic contacting mechanism will be described. Part (a) of FIG. 3 is a schematic side view showing a state in which the charging roller and the photosensitive member are spaced from each other by the spacer member. Part (b) of FIG. 3 is a schematic side view illustrating a state in which the charging roller and the photosensitive member are contacted to each other by transmission of the driving force to the cartridge. The charging roller 2 is rotated by the photosensitive drum 1, and the charging roller 2 is pressed toward the photosensitive drum 1 by the spring 101 through a pressing bearing 102. Hereinafter, the state of the part (a) of FIG. 3 will be called "spaced state", and the state of the part (b) of FIG. 3 will be called "contact state".

The process cartridge 5 is shipped in the spaced state (unused new state) as shown in part (a) of FIG. 3, and receives the drive from the image forming apparatus to become in the contact state as shown in part (b) of FIG. 3.

The description will be made as to a change of the shaft between distance before and after the operation of the automatic contacting mechanism. As will be apparent from the Figure, the spacer member 100 has a sector gear. Therefore, the spacer member 100 retracts (contact state) by receiving the drive from the motor M, and then does not receive the driving force from the motor M.

Here, a distance between the rotational center of the spacer member 100 and the rotation axis of the photosensitive drum 1 in the spaced state (part (a) of FIG. 3) is Y. In addition, a distance between the rotational center of the spacer member 100 and the rotation axis of the retracting means 30 (gear) for transmitting the driving force to the spacer member in the spaced state is Y'. Similarly, the distance between the rotational center of the spacer member 100 and the rotation axis of the photosensitive drum 1 in the contact state (part (b) of FIG. 3) is X. In addition, a space distance between the rotational center of the spacer member 100 and the rotational center 30*a* of the retracting means 30 for transmitting the driving force to the spacer member 100 in contact state is X'.

At this time, a distance relationship between the rotation axis of the photosensitive drum 1 and the rotation axis of the charging roller 2 is X<Y. Similarly, a distance relation between the rotation axis of the gear 30 as the retracting means and the rotation axis of the charging roller 2 is X'<Y'. In the spaced state (part (a) of FIG. 3), the spacer member 100 and the retracting means 30 are engaged with each other. Therefore, as long as the retracting means 30 is not driven, the spacer member 100 is fixed by a gear train including a drum gear 31 or the like as maintaining means.

In addition, in contact state (part (b) of FIG. 3), the space distances between the rotational center of the spacer member 100 co-axial with the rotation axis of the charging roller 2, and the rotational center 30*a* of the retracting means (gear) 30 satisfy X'<Y'. However, the configuration of the spacer member 100 is convex relative to the photosensitive drum 1, the spacer member 100 is not reengaged with the gear 30 after the releasing of the spacing. In addition, even if the photosensitive drum 1 is reversely rotated, the charging roller 2 is not re-spaced from the photosensitive drum 1 because the gear 30 and the spacer member 100 are not contacted with each other. Therefore, even if the photosensitive drum is reversely rotated to prevent passing of the toner stagnated on the cleaning blade, no problem arises. That is, even if the photosensitive drum 1 is reversely rotated in the contact state, the state does not restore to the spaced state.

In this embodiment, the spacer member 100 after the spacing release, is prevented from contacting to the photosensitive drum 1 by an urging force of a spring, although not shown in the Figure. The urging force of the spring is applied in the space state in the first attitude (contact state) shown in part (b) of FIG. 3. However, in the spaced state, the gear of the retracting means 30 fixed by the gear train such as the drum gear 31 as the maintaining means and the tooth configuration portion 100*a* of the spacer member 100. By this, the spacing state is not released by the force of the spring until the driving force is inputted from the image forming apparatus.

(Curvature of Anti-Vibration Property and Space Keeping Portion)

Figure 4:
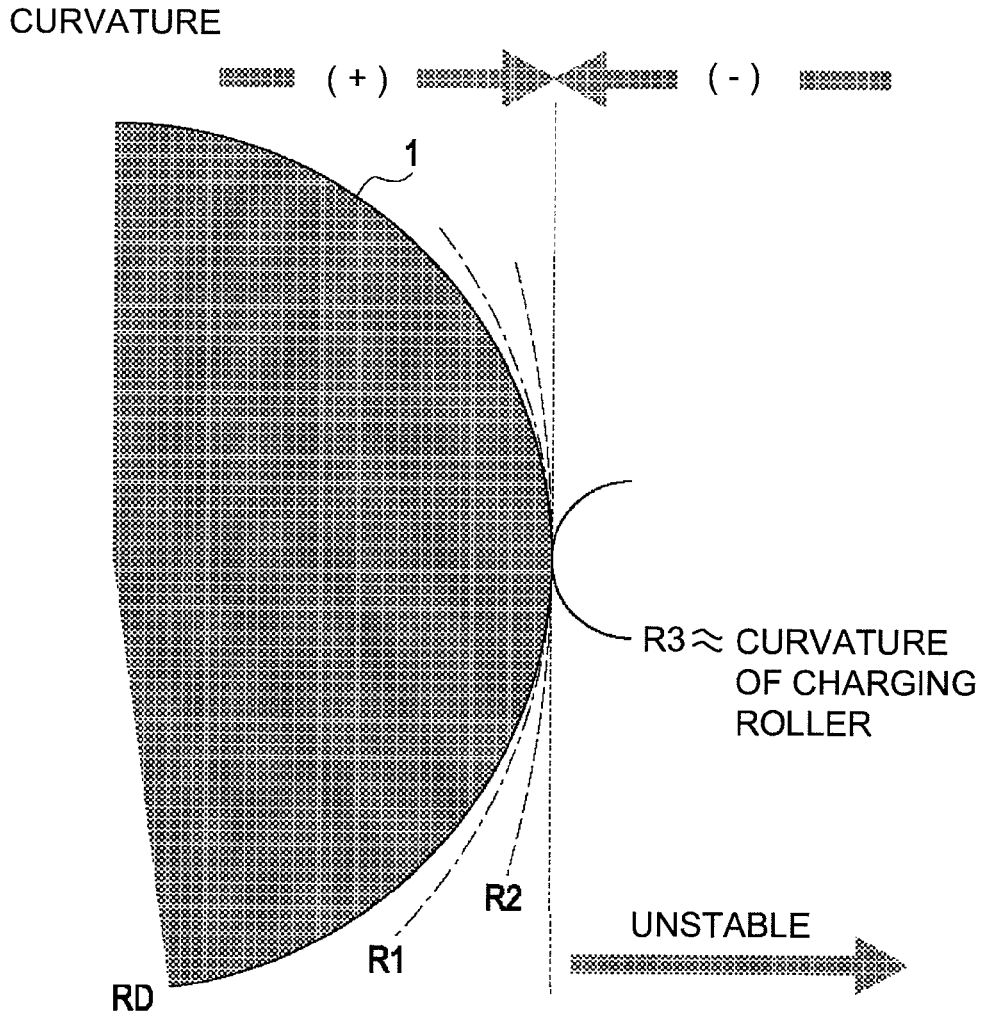
FIG. 4 is a view illustrating a configuration of a spacing portion.

FIG. 4 illustrates a configuration of the space keeping portion P1 of the spacer member 100. As described hereinbefore, the center of curvature of the space keeping portion P1 is in the side of the rotation axis of the photosensitive member not in the side of the rotation axis of the charging roller (radius of curvature is in positive side). If the configuration of the space keeping portion P1 has a center of the curvature in the side of the rotation axis of the charging roller (radius of curvature is negative), the space keeping portion and the portion-to-be-contacted are contacted to each other in a point-to-point-like fashion.

When a vibration is imparted to the process cartridge, the spacer member tends to move (by a vibration component in the tangent line direction between the photosensitive member and the charging roller). Here, in the case that the configuration of the space keeping portion P1 is convex relative to the photosensitive member (radius of curvature is negative), no force in the direction of returning the spacer member having moved by the vibration to the original position (stable position). However, the configuration of the space keeping portion P1 is concave (radius of curvature is positive) relative to the photosensitive member, a force is applied in the direction of returning the spacer member to the original position (stable position) even if the spacer member has been moved by the vibration. This is because the spacer member 100 is concave or recessed, and therefore, the spacer member 100 tends to move toward the position where the distance between the rotation axis of the spacer member and the rotation axis of the photosensitive member is minimum. When the distance is minimum, the length of the spring 101 urging the charging roller 2 toward the photosensitive drum 1 is maximum.

Therefore, if the configuration of the space keeping portion (spacing portion) P1 is convex toward the photosensitive member, the movement of the spacer member 100 to the position where the charging roller contacts the photosensitive member can be suppressed even if a vibration is imparted to the process cartridge as a feature.

Additionally, the durability against the vibration enhances if the radius of curvature of the space keeping portion P1 is such that it extends along the curvature of the photosensitive member rather than along the tangent line. Here, an arcuation of the space keeping portion P1 of the spacer member 100 has a radius of curvature of 15 mm (constant) in the range of the curve, the curvature being substantially the same as that of the photosensitive member). The arcuation of the space keeping portion P1 may be a curve (easement curve) gradually changing to the predetermined arcuation. Employment of such a configuration improves a dynamic stability of the spacer member. The dynamic stability enhances with closeness to the radius of curvature RD of the photosensitive member. As shown in FIG. 4, when the comparison is made between the radius of curvature R1 and the radius of curvature R2, the stability is better with the radius of curvature R1.

By employing the automatic contact structure described above, the user is not required to release a pressure releasing mechanism (removing a spacing pin, for example). Furthermore, a sheet jamming due to failure of removal of the spaced pin or an occurrence of image defect such as an improper charging can be suppressed (improvement in the usability). In the automatic contacting mechanism of this embodiment, the spacer member 100 once disengaged is never reengaged. Therefore, even if the photosensitive member is rotated in the direction opposite to that in the image forming operation for the purpose of protection of the cleaning blade or the like, no excessive load is applied to the cartridge or the driving type.

In addition, the engaging portion between the driven portion P2 and the retracting means 30 is out of the line result the rotation axes of the charging roller and the photosensitive member, and therefore, a pressure application to the tooth meeting portion of the gears can be suppressed. The spacer member is hardly disengaged until the retracting means 30 receives the driving force, and the configuration of the space keeping portion provides the dynamic stability, and therefore, the durability against the vibration is high. It can be avoided that a rubbing memory (contamination of the photosensitive member) and deformation of the charging roller occur due to fine sliding between the charging roller and the photosensitive drum which occurs when the spacing between the charging roller and the photosensitive drum is released resulting in contact therebetween during the process cartridge transportation. The occurrence of the image defect attributable to deposition of the substance seeped from the charging roller 2 onto the photosensitive member can be suppressed.

The drive transmitting means for the automatic contacting mechanism may use a frictional resistance between the parts or a hooking claw or the like. Or, the use may be made with a spacer member 100 loosely fitted around the supporting shaft of the charging brush, the charging blade, the cleaning blade or the like. By doing so, the drum memory (photosensitive drum contamination) due to the jittering of the member contacting the photosensitive member can be suppressed.

3. Block Diagram of Image Forming Apparatus:

A schematic structure and an operation of the image forming apparatus to which the process cartridge is mounted will be described.

(Control Signal System)

Figure 5:
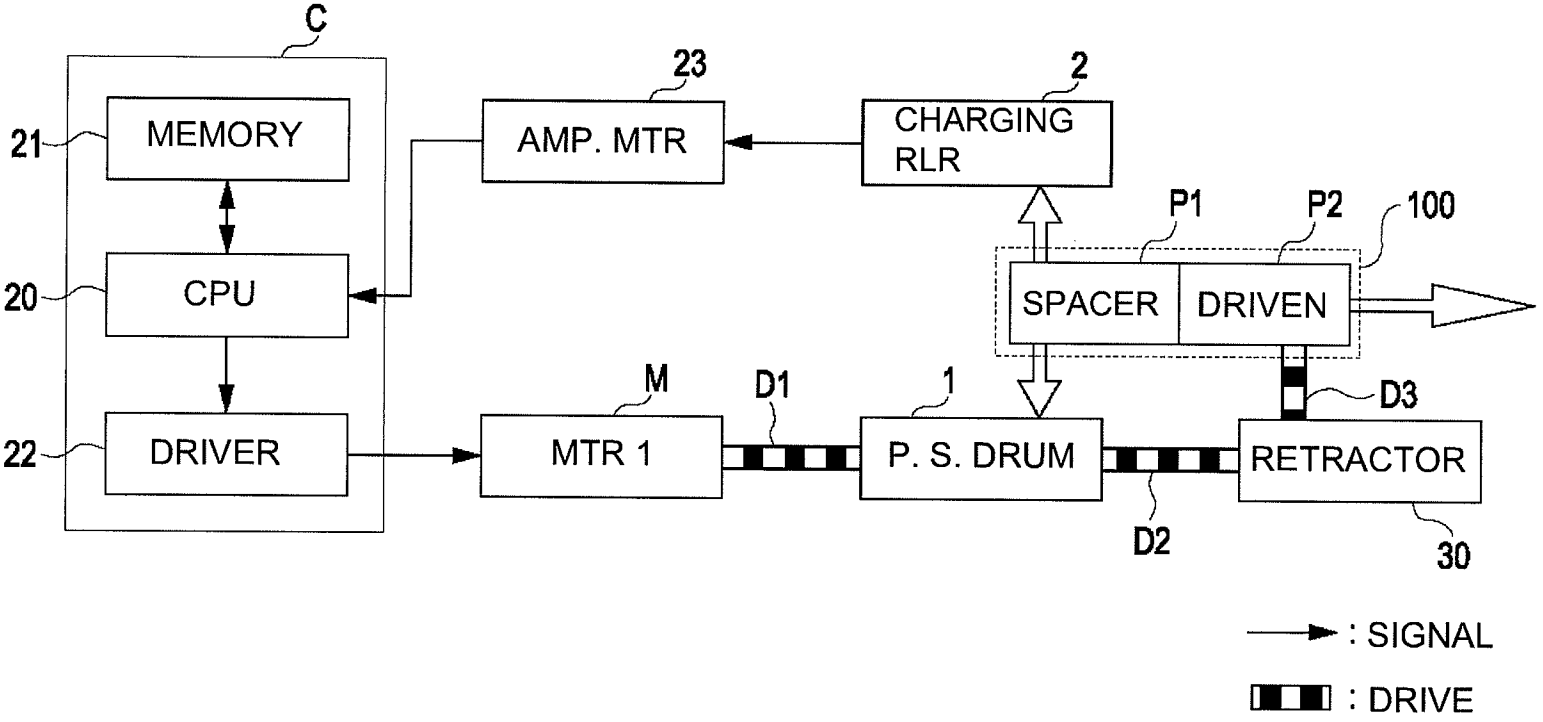
FIG. 5 is a block diagram illustrating a structure of the image forming apparatus.

FIG. 5 is a block diagram illustrating a schematic structure of the image forming apparatus loaded with the process cartridge. The image forming apparatus is provided with a controller C as control means. The controller C comprises a CPU20 (Central Processing Unit), memory 21 and a driver 22. The CPU controls the driver 22 to control rotation of the motor M in accordance with a program stored in the memory. The controller C can change the charging bias voltage for applying to the charging roller and a bias voltage for applying to another image forming portion. In addition, there is provided an ammeter 23 as detecting means for detecting a current flowing between the photosensitive member 1 and the charging roller 2. A result of detection of the ammeter 23 is notified to the controller and is used for the control of the image forming apparatus. More specifically, the detection result of the ammeter 23 is used for the control for confirming contact between the charging roller and the photosensitive member.

(Drive Transmission System)

Next, a drive transmission path will be described simply. The image forming apparatus includes a motor for driving the process cartridge. The photosensitive member 1 is rotated by receiving the driving force from the motor M through a driving train D1. The retracting means 30 is rotated by receiving a driving force from the motor M provided in the main assembly of the apparatus (D2). By the spacer member 100 receiving the driving force at the driven portion P2 from the retracting means 30, the charging roller is brought into contact to the photosensitive member. The driving train connected with the driven portion P2 of the spacer member 100 is not limited to the structure of this embodiment.

4. Operation of the Image Forming Apparatus:

Referring to a flow chart, the operation of the image forming apparatus loaded with the process cartridge will be described.

(Start-Up Process)

Figure 6:
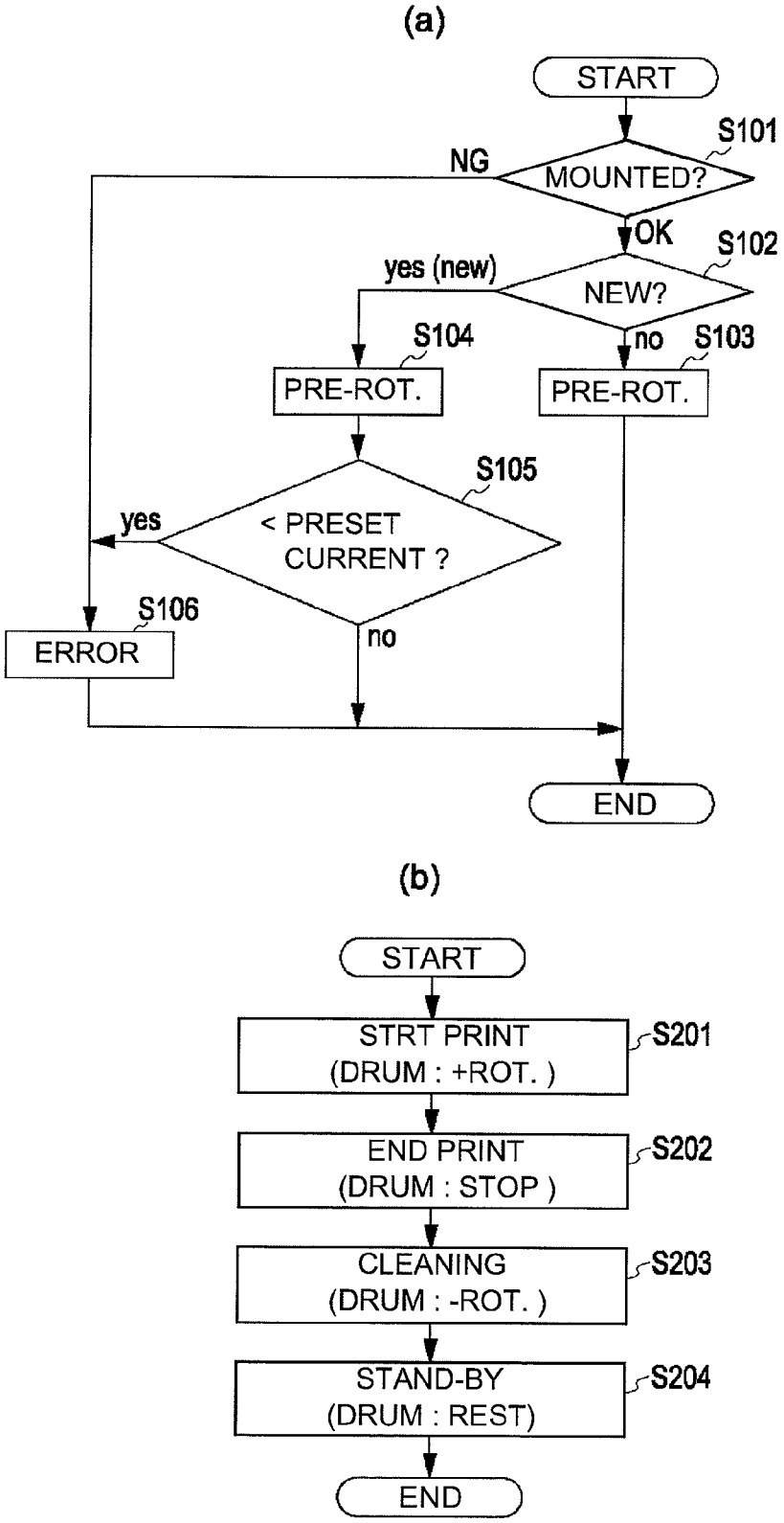
FIG. 6 is a flow chart illustrating an operation of the image forming apparatus.

Part (a) of FIG. 6 is a flow chart showing a process from actuation of the voltage source or exchange of the cartridge to a stand-by state. First, the CPU20 as the control means discriminates whether or not the process cartridge is mounted to the image forming apparatus (S101). More specifically, on the basis of an output of a sensor (unshown) provided in the main assembly of the apparatus, when the process cartridge is not mounted, an error display is made on a display screen (unshown) as displaying means.

When the process cartridge is mounted, the CPU20 switches the operation in accordance with the state of the process cartridge (S102). The CPU20 reads information written in an IC tag provided on the process cartridge as the image forming unit to discriminate whether or not the process cartridge is new. If it is new, the CPU20 carries out the process of S104, and if not, the CPU20 carries out the process of S103. When the process cartridge is not new, the automatic contacting mechanism has operated so that the charging roller is in contact with the photosensitive member. Therefore, a multiple pre-rotation step is carried out to rotate the photosensitive member for a predetermined duration and to adjust image forming conditions until the stand-by state is established.

When the process cartridge is new, the charging roller is spaced from the photosensitive member. Therefore, the photosensitive member is rotated to operate the automatic contacting mechanism. In this embodiment, the photosensitive member is rotated in the direction which is the same as that during the image formation to bring the charging roller into contact to the photosensitive member (S104).

Subsequently, the confirmation is made as to whether or not the automatic contacting mechanism operates in order by which the charging roller is contacted to the photosensitive member (S105). The CPU20 obtains a discharge starting voltage value stored in the memory 21 at which the electric discharge starts in the gap between the charging roller and the photosensitive member at the time when the charging roller is contacted to the photosensitive member. Thereafter, a charging bias voltage not less than the regulation value (DC-900V, for example) obtained from the memory is applied to the charging roller as charging member from the high voltage source S as the applying means. When the charging roller is contacted to the photosensitive member as a result of the proper operation of the automatic contacting mechanism, a current due to the discharge flows between the photosensitive member and the charging roller. If, on the contrary, the charging roller is spaced from the photosensitive member despite the rotation of the photosensitive member, the gap between the charging roller and the photosensitive member is too broad to cause the electric discharge by the application of −900V. In other words, if the charging roller and the photosensitive member are in the spaced state, the application of the predetermined charging bias voltage to the charging roller controlled by the CPU does not result in the detection of the predicted current between the charging roller and the photosensitive member by the ammeter 23. Thus, the CPU20 confirms the operation of the automatic contacting mechanism, and when the charging roller is contacted to the photosensitive member (OK in S105), the automatic contacting process is completed, so that the stand-by state is established. If the current is not more than a desired approx. 150 mA (predetermined value) despite the application of −1300V to the charging roller (NG in S105), the CPU20 executes the process of S106.

The step S106 is a step for notifying an error to the user (or a device manager). When the process cartridge is not mounted, or when the automatic contacting mechanism does not operate properly, the CPU20 as the control means notifies the error information. More specifically, the content of the error is displayed on the display screen of the image forming apparatus, and further, it is notified to the device manager through a network. When the error occurs, the CPU20 displays an error correcting process on the display screen without proceeding to the stand-by in which the image forming operation is possible.

(Operation at the Time of Completion of Image Forming Operation)

Part (b) of FIG. 5 is a flow chart illustrating the process at the time when an image formation signal is inputted in the state (stand-by state) in which the image forming operation is possible.

When an image formation signal (JOB) is inputted to the image forming apparatus, the CUP20 as the control means rotates photosensitive member in the forward direction (direction indicated by the arrow in FIG. 1). Then, it controls the image forming portions in accordance with the inputted image formation signal to form an image on a sheet. When the output of the instructed image is completed, the CPU20 ends the print (S202). At this time, the CPU stops the rotation of the photosensitive member.

Thereafter, a process for preventing image defect due to passing of the toner stagnated on the cleaning blade is carried out (S203). More specifically the CPU20 rotates the photosensitive member at rest at that time in the direction opposite to the rotational moving direction during the image forming operation. The photosensitive member is reversely rotated for a predetermined duration, and then the stand-by state is established again.

According to this embodiment, the automatic contacting mechanism prevents the re-spacing of the charging roller from the photosensitive member despite reverse rotation of the photosensitive member (the spacer member is loose fitted around the rotation shaft of the charging roller). Therefore, the photosensitive member can be reversely rotated after the completion of the image forming operation, in order to maintain the cleaning performance of the cleaning blade.

5. Re-Spacing Upon Shipment:

Upon factory shipment, the photosensitive member is rotated in order to confirm whether various parts of the process cartridge are assembled in order. When the photosensitive member is rotated, the charging roller is brought into contact to the photosensitive member by the automatic contacting mechanism. However, the automatic contacting mechanism of this embodiment is such that the charging roller does not re-space from the photosensitive member even if the photosensitive member is rotated in either direction.

With such a structure, in order to re-space the charging roller from the photosensitive member, it would be considered to disassemble the process cartridge after the test and then reassemble it. However, if the assembled cartridge is disassembled, the accuracies before the disassembling cannot be assured.

Figure 7:
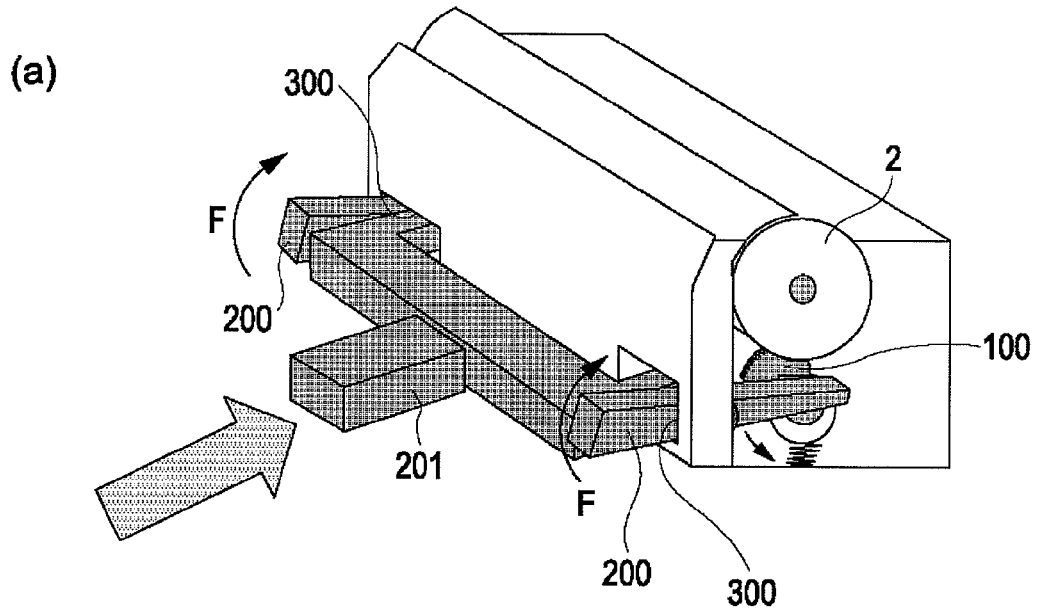
FIG. 7 is a view illustrating a re-spacing step using a specialized tool.
Figure 7:
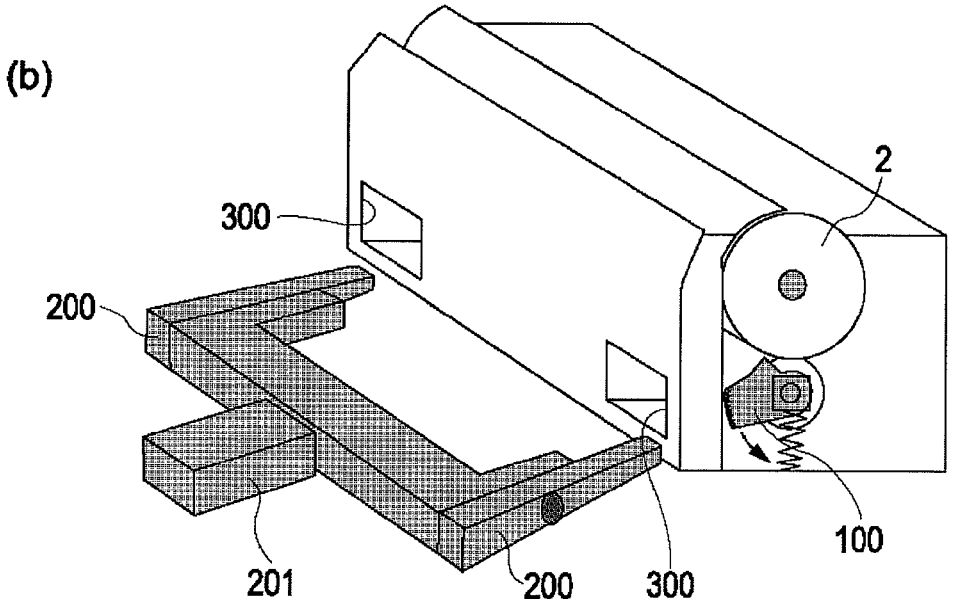

Under the circumstances, the process cartridge of this embodiment is provided with a hole 300 for inserting a re-spacing device for the re-spacing as shown in FIG. 7. By doing so, the charging roller can be spaced from the photosensitive member by the automatic contacting mechanism without the necessity of disassembling the cartridge after the test including the rotation of the photosensitive member. By this, the charging roller and the photosensitive member can be spaced from each other upon the shipment of the cartridge while assuring the assembling accuracies of the cartridge. For the purpose of confirmation of the re-spacing, the contact check bias voltage (approx. −1500V) is applied to the charging roller also at the time of the shipment from the plant.

More specifically, the holes 300 are provided in a side surface of the container of the process cartridge to re-space the charging roller from the photosensitive member. Through the holes 300, end portions of the core metal of the charging roller 2 is pushed down against a pressure (urging force) of the spring 101 by a first special tool. The spacer members 100 provided at the opposite end portions of the charging roller are moved (F in the Figure) simultaneously by a second special tool to space the charging roller and the photosensitive member from each other. By doing so, the spaced state shown in part (a) of FIG. 3 is restored without the necessity of disassembling the process cartridge later the operation check.

That is, the assembling accuracy of the cartridge can be assured, in the automatic contact structure with which the charging roller cannot be re-spaced from the photosensitive member by the rotation of the photosensitive member in either direction.

6. Vibration Evaluation Test:

A process cartridge of the conventional and a process cartridge of this embodiment have been manufactured experimentarily and have been subjected to vibration tests. The sector gear, as the, of the conventional structure has the same gear configuration (module is 0.6) as of the driven portion P2 of this embodiment. The radii of the deddendum circles of the sector gears are the same, and the distance between the space keeping portions (contact portions) P1 and the rotation shafts of the charging rollers are the same (7 mm). The rotation shafts of the charging rollers are press-fitted in the sector gears (spacer member). The nominal diameters of the photosensitive members or the like are the same.

Test conditions of the vibration test will be described. A vibration test device (210i/06) available from IMV Kabushiki Kaisha, Japan was used. Using this, an input waveform is a random waveform (32 kNrms), and a frequency is 20-200 Hz, under which a durability test for 20 hours is carried out.

For evaluation, 10 cartridges of the embodiment and 10 cartridges of the conventional structure are manufactured, and are packed in package boxes, respectively. In addition, cartridges of the conventional structure are placed in a package boxes having a twice volume with buffering foam (air sheet, registered Trademark) in the gaps.

TABLE 1

| | Embodiment | Conventional | Conventional with buffering foam |
|---|---|---|---|
| Number of cartridges In which spaceing is kept | 10 | 2 | 8 |

Table 1 shows the result of the vibration test. In all of the 10 process cartridge of this embodiment, the spaced state between the photosensitive member and the charging roller is maintained even after the tests. As to the case of the cartridges of the conventional structure, two out of 10 cartridges maintain the spaced state. With the case of using the buffering foam, eight out of 10 cartridges maintain the spaced state. In the case of the conventional structure, if the rotation shaft of the charging roller was loosely fitted in the sector gear, and the charging roller was pressed (urged) toward the photosensitive member, the spaced state was not maintained. This is because due to the play of the fitting and due to the vibration, the charging roller is urged in a direction off set from the line connecting the center of the charging roller and the center of the photosensitive member so that the moment tends to be applied in the direction of rotation of the sector spacer member. On the contrary, if the shaft of the charging roller is integrally fastened to the sector gear, the charging roller is not driven by the photosensitive member with the result of improper charging.

It is confirmed that with the conventional structure, maintenance of the spaced state is difficult when the cartridge is subjected to vibration due to the transportation. It is confirmed that when the buffering foam is used, the spaced state can be maintained, although poorer than with this embodiment. However, the use of the buffering material is preferably minimized, since it is simply disposed after the process cartridge is taken out. In addition, increase of the volume of the package box means larger load on the environment for transporting a cartridge. Employing the structure of this embodiment can reduce the use amount of the buffering material and/or the volume.

Embodiment 2

A structure for loose fitting of the spacer member 100 on the rotation shaft of the photosensitive drum in this embodiment will be described. In the description of this embodiment, the same reference numerals as in Embodiment 1 are assigned to the elements having the corresponding functions in this embodiment, and the detailed description thereof is omitted for simplicity.

1. Automatic Contacting Mechanism:

First, the spacer member of this embodiment will be described in brief, and then an operation of the automatic contacting mechanism will be described.

(Spacer Member)

Figure 8:
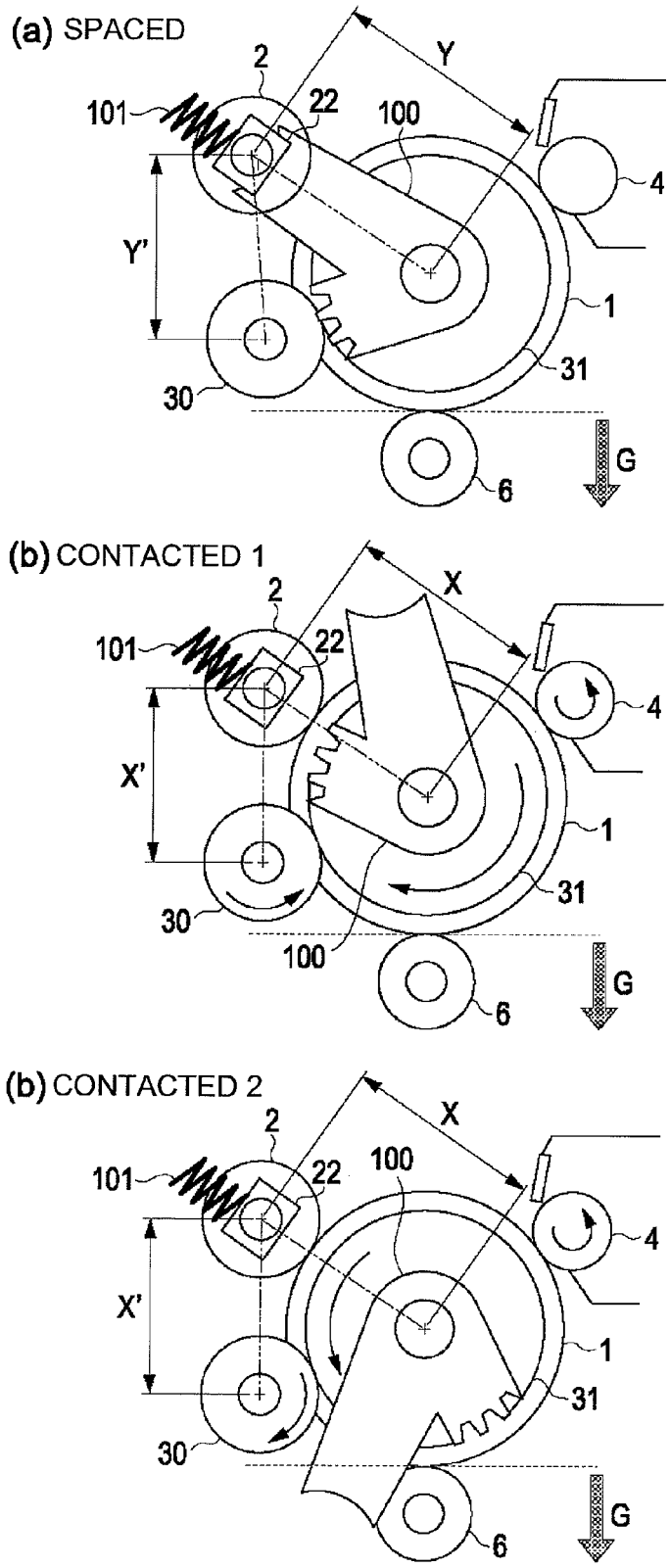
FIG. 8 is a schematic view of a spacing structure according to a modified example.

As shown in FIG. 8, the spacer member 100 of this embodiment is loose fitted around the rotation shaft of the photosensitive member. Similarly to the Embodiment 1, there are provided a gear portion in meshing engagement with a gear 30 as retracting means, and a space keeping portion (P1) for space keeping between the charging roller and the photosensitive member. The configuration of the space keeping portion P2 of this embodiment is recessed or concave toward the charging roller. In addition, the spacer member 100 has a configuration (V-like configuration) with which a distance from a center of the photosensitive drum 1 is different along the circumferential direction of the photosensitive member.

(Operation of the Automatic Contacting Mechanism)

FIG. 8 is a view illustrating the automatic contacting mechanism. Part (a) of FIG. 8 illustrates a spaced state in which the charging roller is spaced from the photosensitive member. Part (b) of FIG. 8 illustrates a contact state in which the charging roller contacts the photosensitive member. An unused (new) process cartridge is shipped from the plant in the spaced state as shown in part (a) of FIG. 8.

The process cartridge mounted to the main assembly of the apparatus receives a driving force from a motor M provided in the main assembly side, so that the spaced state is established (part (b) of FIG. 8).

In the contact state 1 shown in part (b) of FIG. 8, the gear portion of the spacer member 100 and the gear as the retracting means may engage with each other, again. More specifically, the spacer member 100 may rotate about the rotation shaft of the photosensitive drum 1 by the gravity with the result of movement to the re-engagement position. Therefore, the spacer member is preferably retracted into the contact state 2 as shown in part (b) of FIG. 8 so as to prevent the re-engagement once the automatic contacting mechanism operates.

In this embodiment, when it is detected that the process cartridge is new, the spacer member 100 and the gear 30 are prevented from re-engagement by rotation in the direction opposite the direction during the image forming operation. Here, the direction of gravity is preferably taken into account. A position of the gravity center of the spacer member is in the right-hand side of the rotation shaft of the photosensitive member in the Figure (part (a) of FIG. 8). Therefore, if directed of the rotation is the same as the direction during the image forming operation the gears once spaced from each other hit each other. If the spacer member hits and moves away from the gear receiving a power from a drive transmission type for rotating the photosensitive member, a stabilization rotation a photosensitive member is disturbed.

Therefore, with the structure of this embodiment, upon the spacing in the case of a new cartridge, the image forming apparatus preferably rotates the drum in the direction opposite the direction during the image forming operation. For this purpose, a reverse idler gear for reversing the rotation of the gears may be added in the driving train. That is, the spacer member 100 does not engage with the gear 30 as the retracting means even if the gravity center thereof becomes below the rotation axis of the photosensitive drum 1 in the spaced state.

Also in this embodiment, the retracting means 100 is provided with a space keeping portion having a configuration for maintaining stably is spaced state, and a driven portion for receiving the driving force. The spacer member 100 is co-axial with the photosensitive drum 1, and a rotational center of the spacer member 100 is aligned with the rotation axis of the photosensitive drum 1. By doing so, it is not necessary to use an additional shaft to rotate the spacer member 100, and therefore, space saving and simple structure are accomplished. More particularly, the spacer member 100 is co-axial with the photosensitive drum 1 as the photosensitive member, and by the driving force from the motor M as the photosensitive member driving source, the spacer member 100 is rotated co-axially with the photosensitive drum 1 in interrelation with the retracting means 30.

In addition, similarly to Embodiment 1, the relationships X<Y, X'<Y' are satisfied. Moreover, in the spaced state, the spacer member 100 is engaged with the gear 30 to be fixed. Therefore, as long as the driving force is not inputted to the gear train, the spacer member 100 can maintain the spaced state between the charging roller 2 and the photosensitive drum 1.

Embodiment 3

A structure of an image forming apparatus in which the exposure is effected from a bottom side of the process cartridge in this embodiment will be described. With this structure, the re-engagement between the spacer member 100 and the retracting means 30 can be prevented using the gravity.

Figure 9:
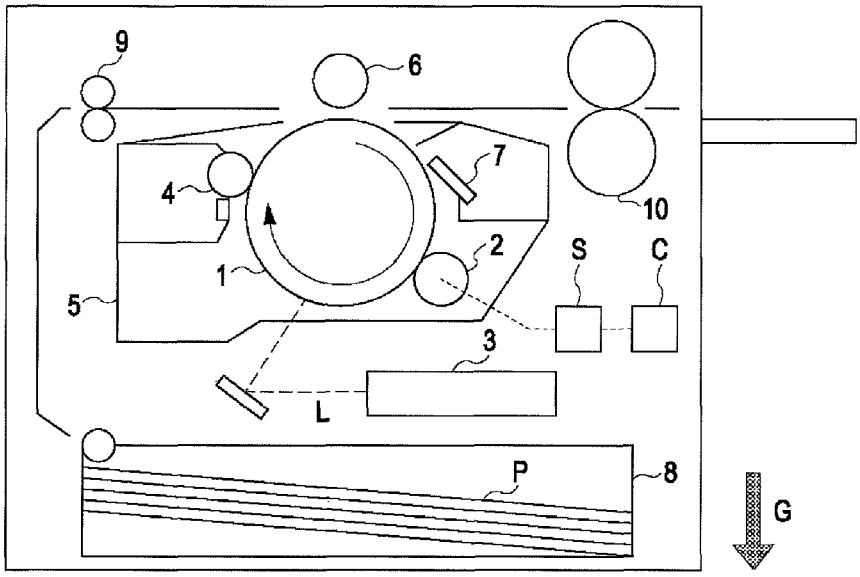
FIG. 9 is a schematic view illustrating a structure of an image forming apparatus.

1. General Arrangement of the Image Forming Apparatus:

FIG. 9 is a view illustrating a schematic structure of the image forming apparatus of this embodiment. In FIG. 9, an arrow G shows the direction of gravity. A process cartridge 5 is mounted to the image forming apparatus upside down with respect to the embodiment 1. The structures are substantially equivalent to the structures of Embodiment 1, and therefore, the detailed description will be omitted for simplicity. The structure of this embodiment may be used with a process cartridge to be mounted to the device for forming a color image on a sheet using a plurality of process cartridges. Further, this embodiment may be used with a structure with which an image formed on the photosensitive member is transferred onto an intermediary transfer member and then is transferred onto the sheet (recording material).

Figure 10:
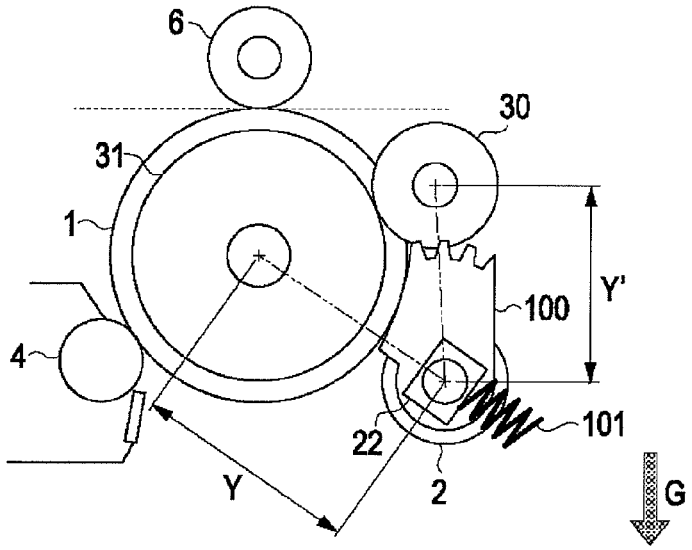
FIG. 10 is a schematic view of a spacing structure according to a modified example.
Figure 10:
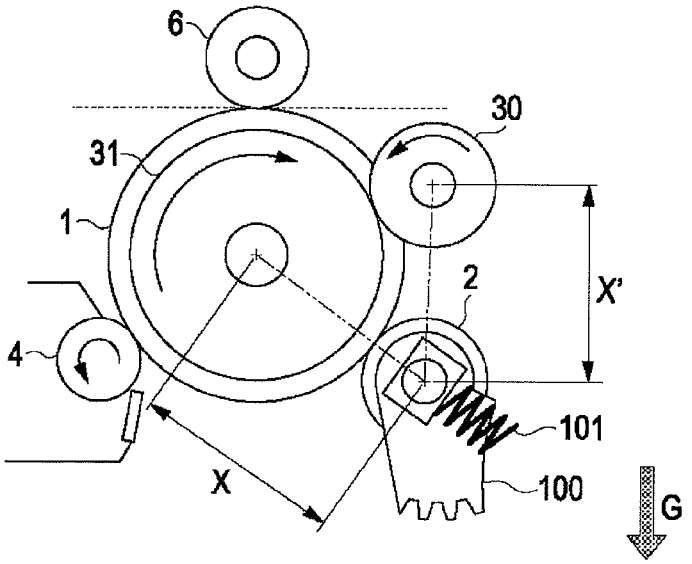

2. Automatic Contact Structure:

An operation of the automatic contacting mechanism of this embodiment will be described. The configuration of the spacer member 100 of this embodiment is the same as that of embodiment 1. An attitude of the process cartridge when it is mounted to the main assembly of the image forming apparatus is different from that of embodiment 1. FIG. 10 is a view illustrating an automatic contact structure in this embodiment. In FIG. 10, the direction of gravity is indicated by an arrow G.

The spacer member 100 is loose fitted around the rotation shaft of the charging roller. In a spaced state (part (b) of FIG. 10), the gravity center of the spacer member 100 is below the shaft of the charging roller. That is, in the spaced state (part (b) of FIG. 10), the spacer member 100 can maintain the position not engaging the gear 30, by the weight. In the case that the charging roller 2 is rotated by photosensitive drum 1, the slip of the charging roller relative to the photosensitive drum can be suppressed by loose fitting the spacer member 100 around the rotation shaft of the charging roller.

Part (a) of FIG. 10 illustrates the spaced state in which the charging roller 2 is spaced from the photosensitive drum 1 by the spacer member 100. Part (b) of FIG. 10 illustrates the contact state in which the charging roller and the photosensitive drum 1 are contacted to each other by rotation of the spacer member 100 by the driving force from the gear 30 as the retracting means receiving the driving force from the main assembly of the device. The new (unused) process cartridge receives the driving force from the motor M provided in main assembly of the apparatus to shift from the spaced state (part (a) of FIG. 10) to the contact state (part (b) of FIG. 10).

Similarly to Embodiment 1, the relationship X<Y, X'<Y'. Moreover, in the spaced state, the spacer member 100 is engaged with the gear 30 to be fixed. Therefore, as long as the driving force is not inputted to the gear train, the spacer member 100 can maintain the spaced state between the charging roller 2 and the photosensitive drum 1.

While the invention has been described with reference to the structures disclosed herein, it is not confined to the details set forth, and this application is intended to cover such modification or changes as may come within the purposes of the improvements or the scope of the following claims. Therefore, the scope of the present invention is recited in the attached Claims.

INDUSTRIAL APPLICABILITY

The present invention, unintended disengagement of the spacer member due to vibration during transportation can be suppressed.

The invention claimed is:

1. An image forming unit detachably mountable to an image forming apparatus, said image forming unit comprising:

a rotatable photosensitive drum;

a charging roller, having an elastic layer and rotatably supported on a rotation shaft, for charging said photosensitive drum by being supplied with a voltage while in contact with said photosensitive drum;

an urging member for urging said charging roller toward said photosensitive drum;

a spacer member, supported rotatably about a rotational axis of said charging roller, for spacing said charging roller and said photosensitive drum from each other by contacting a part of a peripheral surface of said photosensitive drum;

a first gear rotatable by a driving force applied from an image forming apparatus, said first gear being fixed to said photosensitive drum so as to rotate integrally with said photosensitive drum about a rotational axis of said photosensitive drum; and a second gear capable of rotating said spacer member away from said peripheral surface of said photosensitive drum by the driving force to contact said charging roller and said photosensitive drum to each other, wherein said spacer member includes (i) a gear portion for receiving the driving force from said second gear and (ii) a space keeping portion contactable to said photosensitive drum when said charging roller and said photosensitive drum are spaced from each other, said spacer member having a configuration having a curvature with a curvature center in a photosensitive drum rotation axis side in a state that said charging roller and said photosensitive drum are spaced from each other, and a radius of the curvature of said space keeping portion is not less than a radius of curvature of the peripheral surface of said photosensitive drum, wherein said second gear is engaged with said first gear and with said gear portion, and wherein an engaging portion between said gear portion and said second gear is away from a line connecting a rotation axis of the spacer member and a rotational axis of said photosensitive drum.

2. An image forming unit according to claim 1, wherein a curvature of said space keeping portion is substantially the same as a curvature of said photosensitive drum.

3. An image forming unit according to claim 1, wherein a distance between a rotational center of said second gear and a rotational center of said charging roller at the time when said photosensitive drum and said charging roller are spaced from each other by said spacer member is larger than the distance at the time when said photosensitive drum and said charging roller are contacted with each other.

4. An image forming unit according to claim 1, wherein, when said gear portion and said second gear are engaged with each other, a relative positional relationship between said gear portion and said second gear at the time when said gear portion and said second gear all engaged with each other is such that a backlash between said gear portion and said second gear is not removed by an urging force of said urging member.

* * * * *